US010047983B2

(12) United States Patent
Hancock

(10) Patent No.: US 10,047,983 B2
(45) Date of Patent: Aug. 14, 2018

(54) REDUCED POWER HEAT PUMP STARTING PROCEDURE

(71) Applicant: Trane International Inc., Piscataway, NJ (US)

(72) Inventor: Stephen Stewart Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 781 days.

(21) Appl. No.: 14/555,223

(22) Filed: Nov. 26, 2014

(65) Prior Publication Data

US 2015/0159927 A1 Jun. 11, 2015

Related U.S. Application Data

(60) Provisional application No. 61/914,867, filed on Dec. 11, 2013.

(51) Int. Cl.
*F25B 13/00* (2006.01)
*F25B 27/00* (2006.01)

(52) U.S. Cl.
CPC ..... *F25B 27/00* (2013.01); *F25B 13/00* (2013.01); *F25B 2313/004* (2013.01); *F25B 2600/0261* (2013.01)

(58) Field of Classification Search
CPC ..... F25B 13/00; F25B 27/00
See application file for complete search history.

(56) References Cited

U.S. PATENT DOCUMENTS

| | | | | |
|---|---|---|---|---|
| 5,138,844 | A | 8/1992 | Clanin et al. | |
| 5,459,358 | A | 10/1995 | Rose | |
| 5,918,474 | A | 7/1999 | Khanpara et al. | |
| 6,285,178 | B1 | 9/2001 | Ball et al. | |
| 6,859,669 | B2 | 2/2005 | An | |
| 7,331,188 | B2 | 2/2008 | Quilliard et al. | |
| 2005/0210895 | A1* | 9/2005 | Horton | F04B 25/00 62/158 |
| 2011/0068704 | A1* | 3/2011 | McKinney | H05B 33/0815 315/210 |
| 2012/0187764 | A1* | 7/2012 | Rockenfeller | H02J 9/062 307/66 |

OTHER PUBLICATIONS

Max Robinson and Michelle Scepaniak, "Applying VFDs to Refrigeration Systems", Oct. 1 2007 <http://beta.hpac.com/motors-drives/applying-vfds-refrigeration-systems>.*

* cited by examiner

*Primary Examiner* — Jianying Atkisson
*Assistant Examiner* — Antonio R Febles
(74) *Attorney, Agent, or Firm* — Conley Rose, P.C.; J. Robert Brown, Jr.

(57) ABSTRACT

Systems and methods are disclosed that may include providing an auxiliary power source in an HVAC system, establishing a stable, uninterrupted power source to at least one system controller, starting a first component of the HVAC system prior to starting a second component of the HVAC system. The total power requirement necessary to simultaneously start the first component and the second component may generally exceed the power output capacity of the auxiliary power source.

14 Claims, 3 Drawing Sheets

REDUCED POWER HEAT PUMP STARTING PROCEDURE

CROSS-REFERENCE TO RELATED APPLICATIONS

The present application claims priority under 35 U.S.C. § 119(e) to U.S. Provisional Patent Application No. 61/914,867 filed on Dec. 11, 2013 by Hancock, entitled "Reduced Power Heat Pump Starting Procedure," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. Some HVAC systems may be heat pump systems. Heat pump systems may generally be capable of cooling a comfort zone by operating in a cooling mode for transferring heat from a comfort zone to an ambient zone using a refrigeration cycle and also generally capable of reversing the direction of refrigerant flow through the components of the HVAC system so that heat is transferred from the ambient zone to the comfort zone, thereby heating the comfort zone. Heat pumps may sometimes require starting from an auxiliary power source during a power outage. However, starting a heat pump system from a relatively small power source, such as a generator, is often difficult due to the high momentary currents required by inductive electrical components of the heat pump system. Without special procedures and/or systems, a generator may not be capable of delivering the necessary power to start multiple components of the heat pump system simultaneously.

SUMMARY

In some embodiments of the disclosure, an HVAC system is disclosed as comprising a first component comprising a first startup power requirement, a second component comprising a second startup power requirement, an auxiliary power source configured to selectively provide electrical power to at least one of the first component and the second component, and a controller configured to selectively trigger providing the first startup power requirement to the first component from the auxiliary power source prior to providing the second startup requirement to the second component from the auxiliary power source, wherein the first startup power requirement and the second startup power requirement comprise a total startup power requirement that is greater than the power capacity of the auxiliary power source.

In other embodiments of the disclosure, a method of starting an HVAC system is disclosed as comprising: providing an auxiliary power source in an HVAC system; establishing a stable power source to at least one system controller; starting a first component of the HVAC system that comprises a first startup power requirement; and starting a second component of the HVAC system that comprises a second startup power requirement; wherein the sum of the first startup power requirement and the second startup power requirement comprise a total startup power requirement that is greater than the power capacity of the auxiliary power source.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide a starting procedure for an HVAC system, such as, but not limited to a heat pump system. For example, where a power outage may occur due to storms, maintenance, and/or other circumstances that results in shutdown of the HVAC system and where an auxiliary power source configured to run an HVAC system may not supply sufficient power to start multiple components of the HVAC system simultaneously, it may be desirable to provide a starting procedure for an HVAC system to start the HVAC system from an auxiliary power source, such as a generator, in order to continuously provide heat in an indoor climate-controlled area. In some embodiments, systems and methods are disclosed that comprise providing an auxiliary power source in an HVAC system, establishing a stable power source to at least one system controller, starting a first component of the HVAC system, and starting a second component of the HVAC system, wherein the power requirement necessary to simultaneously start the first component and the second component exceeds the power capacity of the auxiliary power source. In some embodiments, the auxiliary power source starting procedure may be used in a heat pump system. In some embodiments, the auxiliary power source starting procedure may be used in a combined heat and power heat pump (CHPHP) system.

Figure 1:
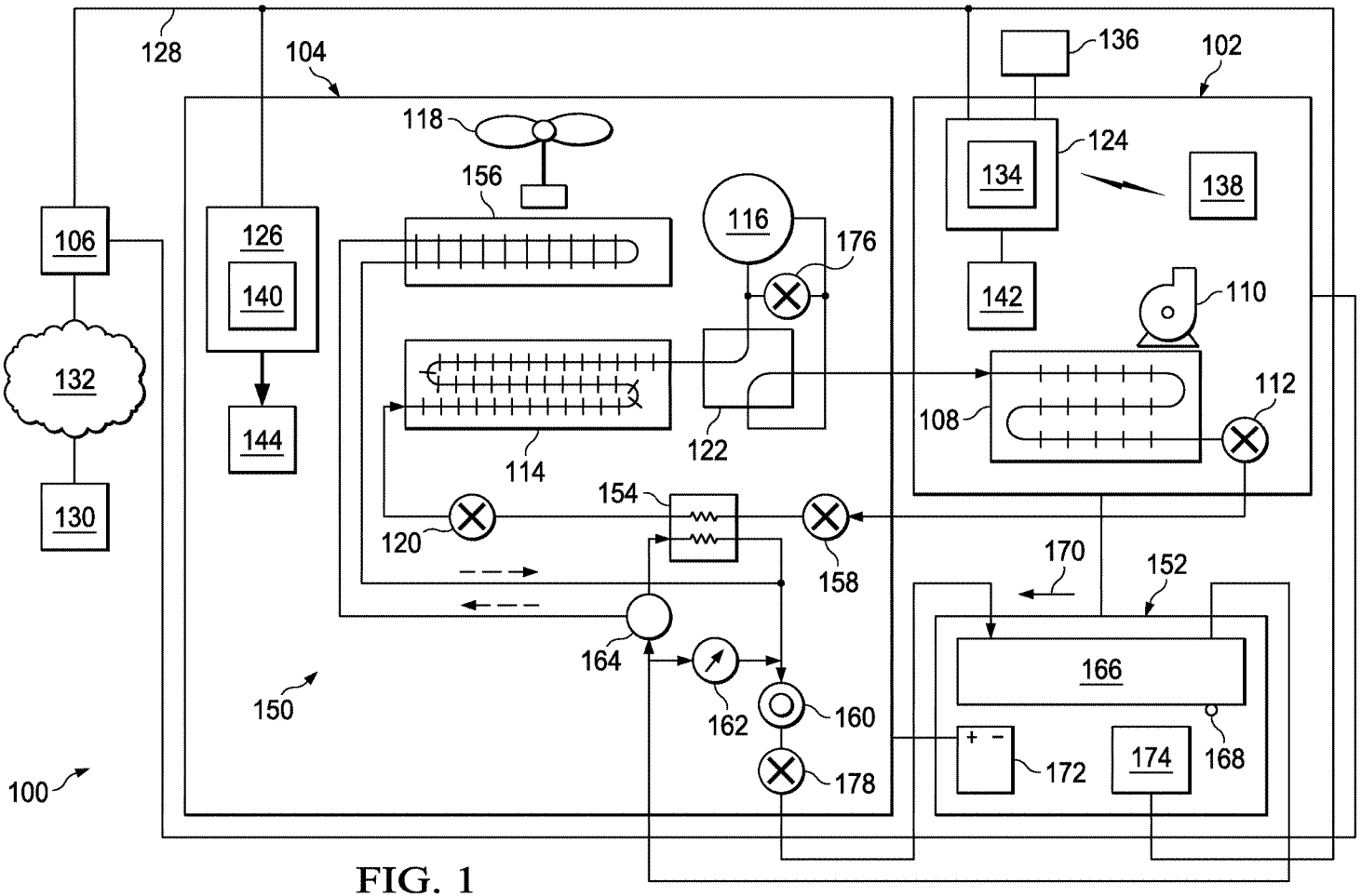
FIG. 1 is a schematic diagram of an HVAC system according to an embodiment of the disclosure.

Referring now to FIG. 1, a simplified schematic diagram of an HVAC system 100 is shown according to an embodiment of the disclosure. HVAC system 100 generally comprises an indoor unit 102, an outdoor unit 104, and a system controller 106. In some embodiments, the HVAC system 100 may also comprise a generator 152 and a generator fluid circuit 150 that is contained within the outdoor unit 104. The system controller 106 may generally control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality. In the embodiment shown in FIG. 1, the outdoor unit 104 may also comprise a recovery heat exchanger 154 and a discharge heat exchanger 156. Furthermore, the HVAC system 100 may also comprise a generator 152 and a generator fluid circuit 150 that is configured to connect the generator 152 to the recovery heat exchanger 154 and the discharge heat exchanger 156.

Indoor unit 102 generally comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger. It will be appreciated that the outdoor heat exchanger 114 may also be referred to as a condenser coil.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, a reciprocating type compressor, a single speed compressor, and/or any other suitable refrigerant compressor and/or refrigerant pump. In some embodiments, the compressor may comprise a compressor unloading valve 176, which may be an actuated valve, a solenoid-controlled valve, and/or a damper which may be connected in parallel to the compressor 116 and configured to control the pressure across the compressor 116.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV similar to indoor metering device 112, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

In some embodiments, the outdoor unit 104 may also comprise an additional metering device 158 coupled to the recovery heat exchanger 154 and configured to regulate the flow of refrigerant therethrough. The metering device 158 may comprise a fixed orifice component, for example, a capillary tube assembly. In alternative embodiments, the metering device 158 may comprise a thermostatic expansion valve, an electronically controlled motor driven EEV, and/or any other suitable metering device. The metering device 158 may also comprise and/or be associated with a refrigerant check valve and/or refrigerant bypass for use when the direction of refrigerant flow through the metering device 158 is such that the metering device 158 is not intended to meter or otherwise substantially restrict flow of the refrigerant through the outdoor metering device 120. In other embodiments, however, the outdoor unit 104 may not include a metering device 158.

Still referring to FIG. 1, the system controller 106 may generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may not comprise a display and may derive all information from inputs from remote sensors and remote configuration tools. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may also selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may be configured to receive information inputs, transmit information outputs, and otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120. In some embodiments, the indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called heating mode in which heat is absorbed by a refrigerant at the outdoor heat exchanger 114 and heat is rejected by refrigerant at the indoor heat exchanger 108. In some embodiments, the compressor 116 may be operated to compress refrigerant and pump the relatively high temperature and high pressure compressed refrigerant from the compressor 116 to the indoor heat exchanger 108 through the reversing valve 122. From the indoor heat exchanger 108, the refrigerant may be pumped unaffected through the indoor metering device 112 to the outdoor metering device 120 and ultimately to the outdoor heat exchanger 114. The refrigerant may experience a pressure differential across the outdoor metering device 120, be passed through the outdoor heat exchanger 114, and ultimately reenter the compressor 116. As the refrigerant is passed through the outdoor heat exchanger 114, the outdoor fan 118 may be operated to move air into contact with the outdoor heat exchanger 114, thereby transferring heat from the air surrounding the outdoor heat exchanger 114 to the refrigerant. The refrigerant may thereafter re-enter the compressor 116 after passing through a second internal passage within the reversing valve 122.

Alternatively, to operate the HVAC system 100 in a so-called cooling mode, most generally, the roles of the indoor heat exchanger 108 and the outdoor heat exchanger 114 are reversed as compared to their operation in the above-described heating mode. For example, the reversing valve 122 may be controlled to alter the flow path of the refrigerant, the indoor metering device 112 may be enabled, and the outdoor metering device 120 may be disabled and/or bypassed. In cooling mode, heat is absorbed by refrigerant at the indoor heat exchanger 108 and heat is rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108.

Still referring to FIG. 1, the HVAC system 100 also comprises a generator 152 and a generator fluid circuit 150. The generator 152 may comprise a generator heat exchanger 166 and a battery 172. The generator 152 may generally be configured to produce and supply electrical power and/or rejected heat to provide at least a portion of the energy consumption and/or heat delivery to the indoor unit 102, the outdoor unit 104, and/or any other component of the HVAC system 100. In some embodiments, the generator 152 may comprise a power capacity that is at least about 10-50% higher than the steady state power requirement of the HVAC system 100, while the HVAC system 100 may require at least two to three times (200-300%) the steady state power requirement to start the components of the HVAC system 100. The battery 172 of the generator 152 may be configured to supply electrical power to the indoor unit 102, the outdoor unit 104, and/or the system controller 106. The battery 172 may also be configured to supply electrical power to the individual components of the indoor unit 102 and/or the outdoor unit 104. In some embodiments, the battery 172 may comprise an uninterrupted electrical power source that is configured to provide an uninterrupted, stable electrical power supply to at least some of the components of the HVAC system 100 during system startup. In some embodiments, the battery 172 may supply electricity to the controllers 106, 124, 126 of the HVAC system 100, while the generator 152 supplies electricity to other components of the HVAC system 100.

In some embodiments, the generator 152 may also comprise a generator controller 174. The generator controller 174 may be configured for selective bidirectional communication over the communication bus 128. In some embodiments, the generator controller 174 may be configured for selective bidirectional communication over communication bus 128 with the system controller 106, the indoor controller 124, and/or the outdoor controller 126. The generator controller 174 may generally be configured to receive information inputs, transmit information outputs, and otherwise communicate with the system controller 106, the indoor controller 124, the outdoor controller 126, and/or any other device 130 via the communication bus 128 and/or any other suitable medium of communication. The generator controller 174 may also selectively cooperate with the system controller 106, the indoor controller 124, and/or the outdoor controller 126 to provide a startup sequence to selectively start the generator 152, the indoor unit 102, the outdoor unit 104, and/or individual components of the generator 152, the indoor unit 102, and/or the outdoor unit 104.

The generator 152 may also comprise an exhaust 170, from which rejected heat is carried by hot exhaust fluid that is expelled from the generator 152 as a result of combustion within the generator 152. In some embodiments, the generator 152 may comprise an electricity generating device comprising and/or powered by an internal combustion engine configured to receive and consume a fuel such as natural gas, propane, gasoline, and/or diesel. In other embodiments, the generator 152 may comprise another electricity generating device including, but not limited to, a fuel cell, a generator powered by a micro-turbine, a thermal-photovoltaic system, and/or any other suitable device capable of supplying electrical power and/or heat. It will be appreciated that a variety of combinations of various fuels and oxidants may also be used. Additional examples of fuels include hydrogen, hydrocarbons, alcohols, and biomass. Examples of oxidants include air, oxygen, chlorine, and chlorine dioxide. A thermal-photovoltaic system may convert solar energy into electricity and/or heat and provide a portion of the power produced to HVAC system 100 without a supply of fuel or oxidizer.

The generator fluid circuit 150 may generally be configured to selectively connect the generator heat exchanger 166 of the generator 152 in fluid communication with the recovery heat exchanger 154 and the discharge heat exchanger 156, both of which are accommodated by and housed within the outdoor unit 104, so that an acceptable heat transfer fluid may selectively flow between the generator heat exchanger 166 and at least one of the recovery heat exchanger 154 and the discharge heat exchanger 156. Heat energy discharged by the generator 152 may therefore generally be carried by the generator fluid circuit 150 from the generator heat exchanger 166 to the recovery heat exchanger 154 and/or the discharge heat exchanger 156. An acceptable heat transfer fluid may comprise water, water and ethylene glycol mixture, brine solution, refrigerant, oil, or any other suitable heat transfer fluid. In some embodiments, the heat transfer fluid may transfer heat, such as rejected heat from the generator 152, to the refrigerant of HVAC system 100 through the recovery heat exchanger 154 and/or the discharge heat exchanger 156.

The generator fluid circuit 150 also comprises a coolant pump 160, a mixing valve 162, and a diverter valve 164, also accommodated by and housed within the outdoor unit 104, and selectively connected in fluid communication through a plurality of fluid conduits. Such fluid conduits may include pipes, tubes, and/or any other suitable conduit which may comprise one or more of a variety of rigid or flexible materials, e.g., polyvinyl chloride (PVC), ductile iron, steel, cast iron, polypropylene, polyethylene, copper, hose with a braided sheath, and/or any other suitable material. The coolant pump 160 may generally be configured to pump the generator heat transfer fluid into inlet tubing associated with the generator heat exchanger 166, through the generator heat exchanger 166, out of the generator heat exchanger 166, through outlet tubing associated with the generator heat exchanger 166, and subsequently to recovery heat exchanger 154 and/or discharge heat exchanger 156 prior to returning the heat transfer fluid to the generator heat exchanger 166. The mixing valve 162 and/or the diverter valve 164 of the generator fluid circuit 150 may be configured to open and close in response to a heating or cooling mode selection by a controller 106, 124, 126 and/or a difference between a measured heat transfer fluid temperature and a heat transfer fluid temperature set-point. For example, when HVAC system 100 is in the so-called heating mode, diverter valve 164 may direct at least a portion of the heat transfer fluid to recovery heat exchanger 154. In some embodiments, the recovery heat exchanger 154 may be configured to promote heat transfer between the heat transfer fluid and the refrigerant flowing through the recovery heat exchanger 154. Alternatively, the diverter valve 154 may direct heat transfer fluid along a different flow path, such as to discharge heat exchanger 156, during operation of HVAC system 100 in a cooling mode. In some embodiments, the discharge heat exchanger 156 may be configured to promote heat transfer between the heat transfer fluid flowing through the discharge heat exchanger 156 and an airflow pulled through the discharge heat exchanger 156 by outdoor fan 118.

In some embodiments, the generator 152 may also comprise a generator temperature sensor 168 configured to measure the heat transfer fluid temperature within the generator fluid circuit 150 and/or the generator heat exchanger 166, a conduit temperature, and/or an internal temperature of the generator 152. In some embodiments, the generator fluid circuit 150 may comprise one or more thermostats, such as generator circuit thermostat 178, and/or temperature sensors to measure a plurality of temperatures associated with the circulated heat transfer fluid. In some embodiments, if a temperature of the heat transfer fluid associated with the generator heat exchanger 166 drops below a selected temperature set-point, the mixing valve 162 may direct a portion of the heat transfer fluid that has received rejected heat from the generator 152 to circulate within the generator fluid circuit 150 and return to the generator heat exchanger 166 without passing through either the recovery heat exchanger 154 or the discharge heat exchanger 156. Alternatively, in some embodiments, the temperature of the heat transfer fluid returning to the generator 152 may be controlled by the generator circuit thermostat 178 that may generally be configured to remain closed until a predetermined return temperature is achieved, at which time the generator circuit thermostat 178 may modulate the flow of the heat transfer fluid to the generator 152 to control that temperature. Thus, at least a portion of the rejected heat from the generator 152 may be directed back to the generator heat exchanger 166, i.e. to the generator 152, where the returning heat may help maintain a generator 152 operating temperature and/or may receive additional heat to reach a threshold temperature for triggering transfer of the heat to at least one of the recovery heat exchanger 154 and the discharge heat exchanger 156.

The rejected heat from the generator 152 may also be utilized for an HVAC system 100 functionality to increase the efficiency of the HVAC system 100. For example, when the HVAC system 100 is operating in the heating mode, the rejected heat may be directed first to the outdoor unit 104 and then transferred to the indoor unit 102 for heating a space to which the indoor unit 102 supplies air. This benefit may be achieved through the transfer of heat, i.e. heat energy, from the heat transfer fluid in the generator fluid circuit 150 to the refrigerant via the recovery heat exchanger 154. Transferring the rejected heat to the refrigerant may therefore augment the transfer of heat occurring within outdoor heat exchanger 114. The transfer of rejected heat from the generator heat exchanger 166 to the refrigerant may generally be referred to as heat recovery.

Figure 2:
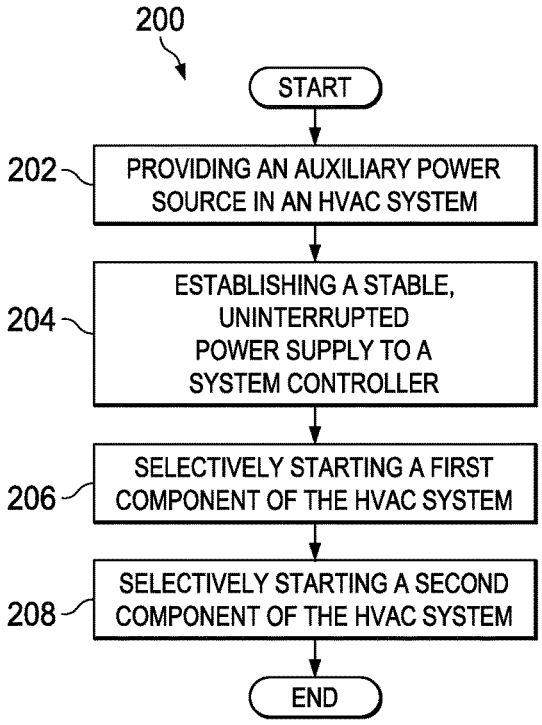
FIG. 2 is a flowchart of a method of starting an HVAC system according to an embodiment of the disclosure.

Referring now to FIG. 2, a method 200 of starting an HVAC system 100 is shown according to an embodiment of the disclosure. The method 200 may begin at block 202 by providing an auxiliary power source in an HVAC system 100. In some embodiments, the auxiliary power source may be a generator, such as generator 152. In some embodiments, the auxiliary power source may comprise a power capacity that is adequate for steady state operation of the system but may be insufficient for a conventional startup. In such embodiments, the auxiliary power source, such may comprise a power capacity that is about 10-50% greater than the steady state power requirement of the HVAC system 100, while the HVAC system 100 may require at least two to three times the steady state power requirement to start the components of the HVAC system 100. The method 200 may continue at block 204 by establishing a stable, uninterrupted power supply to a system controller, such as system controller 106 and/or at least in some embodiments, electromechanical controls such as contactors. In some embodiments, the stable, uninterrupted power supply may also be established to the indoor controller 124, the outdoor controller 126, and/or the generator controller 174. The stable, uninterrupted power source may comprise a battery, such as battery 172, of the auxiliary power source. In some embodiments, the system controller 106, the indoor controller 124, the outdoor controller 126, and/or the generator controller 174 may be configured to provide a startup sequence to operate various components of the HVAC system 100. The method 200 may continue at block 206 by selectively starting a first component of the HVAC system 100. The first component may be any electrical component of HVAC system 100. In some embodiments, the first component may be started by selectively providing power from the auxiliary power source to the first component. In some embodiments, where the first component may comprise variable power requirements, the first component may be started at the lowest power requirement necessary to start the first component. In some embodiments, starting the first component may be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the first component.

The method 200 may conclude at block 208 by selectively starting a second component of the HVAC system 100. The second component may be any electrical component of HVAC system 100 that is not the first component. In some embodiments, the second component may be started by selectively providing power from the auxiliary power source to the second component. In some embodiments, where the second component may comprise variable power requirements, the second component may be started at the lowest power requirement necessary to start the second component or another power requirement less than a maximum power requirement. In some embodiments, starting the second component may also be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the second component. In some embodiments, the first component may comprise a power requirement during startup that is higher than the power requirement of the second component during startup. In some embodiments, the first component may comprise a lowest power requirement during startup that is higher than the lowest power requirement of the second component during startup. In some embodiments, the collective power requirement necessary to simultaneously start the first component and the second component may exceed the power capacity of the auxiliary power source of the HVAC system 100. In some embodiments, the collective power requirement necessary to simultaneously start all components of the HVAC system 100 may be at least about 2-3 times greater than the power capacity of the auxiliary power source.

Figure 3:
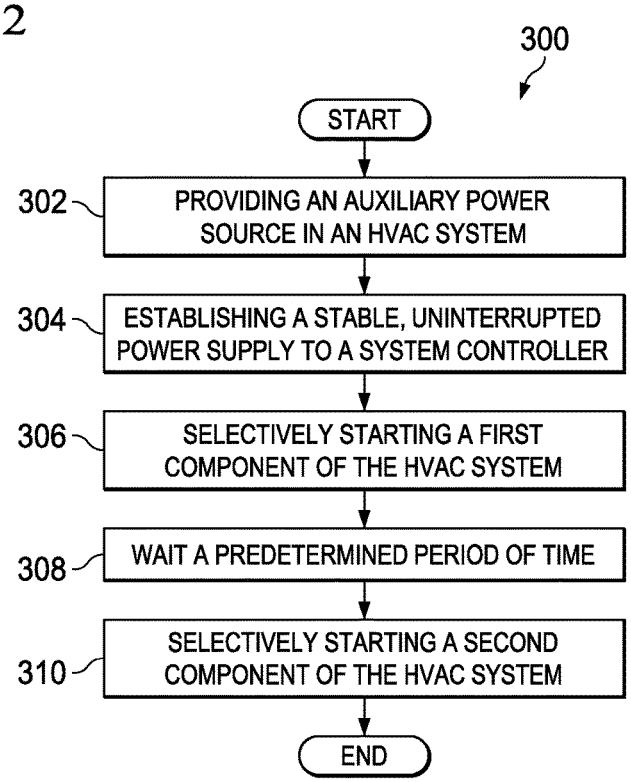
FIG. 3 is a flowchart of a method of starting an HVAC system according to another embodiment of the disclosure.

Referring now to FIG. 3, a method 300 of starting an HVAC system 100 is shown according to an embodiment of the disclosure. The method 300 may begin at block 302 by providing an auxiliary power source in an HVAC system 100. In some embodiments, the auxiliary power source may be a generator, such as generator 152. In some embodiments, the auxiliary power source may comprise a power capacity that is about 10-50% greater than the steady state power requirement of the HVAC system 100, while the HVAC system 100 may require at least two to three times the steady state power requirement to simultaneously start the components of the HVAC system 100. The method 300 may continue at block 304 by establishing a stable, uninterrupted power supply to a system controller, such as system controller 106. In some embodiments, the stable, uninterrupted power supply may also be established to the indoor controller 124, the outdoor controller 126, and/or the generator controller 174. The stable, uninterrupted power source may comprise a battery, such as battery 172, of the auxiliary power source. In some embodiments, the system controller 106, the indoor controller 124, the outdoor controller 126, and/or the generator controller 174 may be configured to provide a startup sequence to operate various components of the HVAC system 100. The method 300 may continue at block 306 by selectively starting a first component of the HVAC system 100. The first component may be any electrical component of HVAC system 100. In some embodiments, the first component may be started by selectively providing power from the auxiliary power source to the first component. In some embodiments, where the first component may comprise variable power requirements, the first component may be started at the lowest power requirement necessary to start the first component. In some embodiments, starting the first component may be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the first component.

The method 300 may continue at block 308 by waiting for a predetermined period of time. Because starting the first component of the HVAC system 100 may result in a voltage drop in the power output of the auxiliary power source, it may be desirable to wait a predetermined period of time to allow the auxiliary power source to stabilize, thus recovering from the incurred voltage drop in the output of the auxiliary power source caused by starting the first component. In some embodiments, the auxiliary power source may require at least about 5-10 seconds to stabilize. However, in some embodiments, the predetermined period of time may comprise at least about 5-30 seconds. In some embodiments, the controller may be configured to wait a predetermined period of time, ranging between at least about 5 to at least about 30 seconds, in some embodiments, as a function of the power requirements of the first component. Accordingly, the controller may be configured to wait a longer predetermined period of time for a first component that comprises a higher power requirement during startup as compared to a second component as described below.

The method 300 may conclude at block 310 by selectively starting a second component of the HVAC system 100. The second component may be any electrical component of HVAC system 100 that is not the first component. In some embodiments, the second component may be started by selectively providing power from the auxiliary power source to the second component. In some embodiments, where the second component may comprise variable power requirements, the second component may be started at the lowest power requirement or another power requirement less than a maximum power requirement necessary to start the second component. In some embodiments, starting the second component may also be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the second component. In some embodiments, the first component may comprise a power requirement during startup that is higher than the power requirement of the second component during startup. In some embodiments, the first component may comprise a lowest power requirement during startup that is higher than the lowest power requirement of the second component during startup. In some embodiments, the collective power requirement necessary to simultaneously start the first component and the second component may exceed the power capacity of the auxiliary power source of the HVAC system 100.

Figure 4:
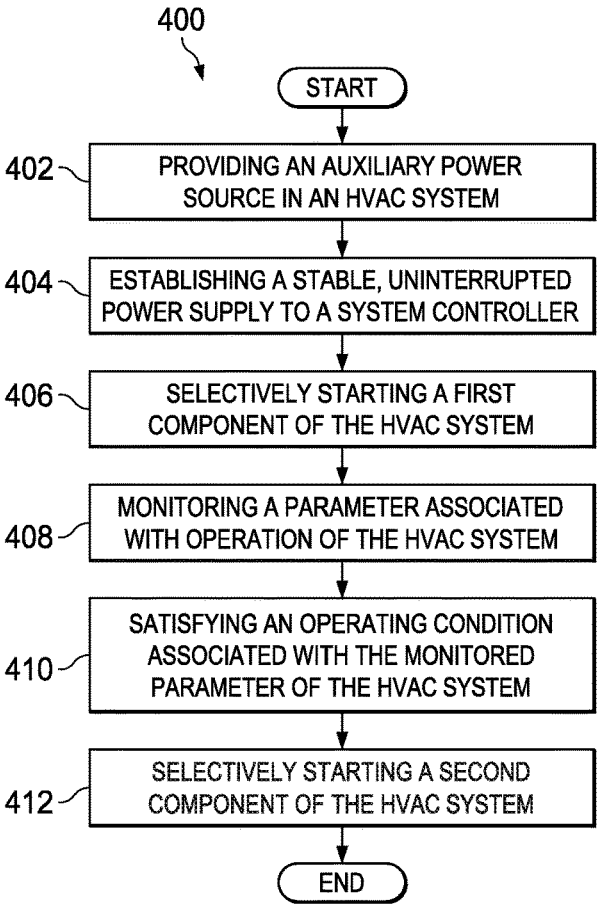
FIG. 4 is a flowchart of a method of starting an HVAC system according to yet another embodiment of the disclosure.

Referring now to FIG. 4, a method 400 of starting an HVAC system 100 is shown according to an embodiment of the disclosure. The method 400 may begin at block 402 by providing an auxiliary power source in an HVAC system 100. In some embodiments, the auxiliary power source may be a generator, such as generator 152. In some embodiments, the auxiliary power source may comprise a power capacity that is about 10-50% greater than the steady state power requirement of the HVAC system 100, while the HVAC system 100 may require at least two to three times the steady state power requirement to start the components of the HVAC system 100. The method 400 may continue at block 404 by establishing a stable, uninterrupted power supply to a system controller, such as system controller 106. In some embodiments, the stable, uninterrupted power supply may also be established to the indoor controller 124, the outdoor controller 126, and/or the generator controller 174. The stable, uninterrupted power source may comprise a battery, such as battery 172, of the auxiliary power source. In some embodiments, the system controller 106, the indoor controller 124, the outdoor controller 126, and/or the generator controller 174 may be configured to provide a startup sequence to operate various components of the HVAC system 100. The method 400 may continue at block 406 by selectively starting a first component of the HVAC system 100. The first component may be any electrical component of HVAC system 100. In some embodiments, the first component may be started by selectively providing power from the auxiliary power source to the first component. In some embodiments, where the first component may comprise variable power requirements, the first component may be started at the lowest power requirement or another power requirement less than a maximum power necessary to start the first component. In some embodiments, starting the first component may be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the first component.

The method 400 may continue at block 408 by monitoring an operating parameter associated with operation of the HVAC system 100. As stated, starting the first component of the HVAC system 100 may result in a voltage drop in the power output of the auxiliary power source. Thus, the auxiliary power source must stabilize before a second component is started. In some embodiments, the auxiliary power source and/or the controller may comprise sensors configured to monitor the voltage and/or power output of the auxiliary power source. In some embodiments, the auxiliary power source and/or the controller may be configured to communicate bi-directionally to transmit and/or receive information related to the monitored operating parameter. In some embodiments, the monitored operating parameter may comprise a power output of the auxiliary power source. In other embodiments, the monitored parameter may comprise a steady state power requirement of the first component of the HVAC system 100. In yet other embodiments, the monitored parameter may be a heat transfer fluid temperature and/or any other variable associated with operation of the HVAC system 100 that may provide indication that a subsequent component may be started.

The method 400 may continue at block 410 by satisfying an operating condition associated with the monitored parameter of the HVAC system 100. Most generally, the operating condition may be satisfied when the monitored parameter reaches a predetermined threshold. In some embodiments, for instance where the monitored parameter comprises a power output of the auxiliary power source, the operating condition may be met when the auxiliary power source is capable of maximum power output. Similarly, in some embodiments, the operating condition may be met when the auxiliary power source recovers from the voltage drop associated with starting the first component, and the power output of the auxiliary power source reaches a specified threshold power output. In some embodiments, satisfying the condition may be determined by the controller and/or any controller associated with the auxiliary power source and/or configured to communicate with a sensor and/or monitor associated with either of the controller and the auxiliary power source. In some embodiments, the controller and/or any controller associated with the auxiliary power source may be configured to wait a predetermined period of time after the operating condition associated with the monitored parameter is satisfied. As stated, the predetermined period of time may comprise at least about 5-30 seconds.

The method 400 may conclude at block 412 by selectively starting a second component of the HVAC system 100. The second component may be any electrical component of HVAC system 100 that is not the first component. In some embodiments, the second component may be started by selectively providing power from the auxiliary power source to the second component. In some embodiments, where the second component may comprise variable power requirements, the second component may be started at the lowest power requirement necessary to start the second component. In some embodiments, starting the second component may also be selectively controlled by the system controller 106, the indoor controller 124, and/or the outdoor controller 126. It will also be appreciated that the generator controller 174 may also selectively cooperate with the system controller 106, the indoor controller 124, and/or the outdoor controller 126 to provide a startup sequence to selectively start the second component. In some embodiments, the first component may comprise a power requirement during startup that is higher than the power requirement of the second component during startup. In some embodiments, the first component may comprise a lowest power requirement during startup that is higher than the lowest power requirement of the second component during startup. In some embodiments, the collective power requirement necessary to simultaneously start the first component and the second component may exceed the power capacity of the auxiliary power source of the HVAC system 100.

Referring back to FIGS. 1-4, the HVAC system 100 may generally be configured to operate from power supplied by generator 152 when main power to the HVAC system 100 is lost. Because many electrical devices, especially inductive devices, exhibit high momentary current draw during startup, the generator 152 may not be capable of starting multiple components of the HVAC system 100 simultaneously. In some embodiments, the generator 152 may comprise a power capacity that is about 10-50% greater than the steady state power requirement of the HVAC system 100, while the HVAC system 100 may require at least two to three times (200-300%) the steady state power requirement to start the components of the HVAC system 100. Thus, HVAC system 100 may require a special startup procedure to start the components of the HVAC system 100 from the generator 152. When main power to the HVAC system 100 is lost, the generator 152 may be configured to automatically start. In other embodiments, a controller, such as controller 106, 124, 126, 174 may be configured to trigger starting the generator 152. Once started, the generator 152 may be configured to stabilize its power output before starting any of the components of the HVAC system 100. Because electro-mechanical and electronic controls may be sensitive to voltage, once the power output of the generator 152 is stabilized, a stable, uninterrupted power source, such as battery 172 of the generator 152, may be configured to provide electrical power to the electro-mechanical and electronic controls of the HVAC system 100. In some embodiments, the battery 172 may provide uninterrupted, stable power to the controllers 106, 124, 126 and/or any other controller configured to control the operation of the HVAC system 100 in addition to any electronic device that is configured to measure temperature, humidity, and/or any other environmental variable associated with operation of the HVAC system 100.

After a stable power source is established for the controls of the HVAC system 100, it may be necessary to provide cooling to the generator 152. Accordingly, a generator cooling pump, such as coolant pump 160, may be started in order to keep the generator 152 cool. In some embodiments, the coolant pump 160 may be started based on a temperature of the generator heat transfer fluid as measured by the generator temperature sensor 168. If the generator 152 has been idle and/or not operating for an appreciable period of time, the temperature of the generator heat transfer fluid may be low, thus not requiring the generator 152 to discharge any excess heat. Thus, in some embodiments, when the heat transfer fluid of the generator 152 as measured by generator temperature sensor 168 falls below the predetermined temperature threshold, the coolant pump 160 may not be started. Contrarily, when the heat transfer fluid of the generator 152 as measured by the generator temperature sensor 168 exceeds the predetermined temperature threshold, it may be necessary to start the coolant pump 160.

Once the generator 152 is started, a stable power source has been established to the system controller 106, and components necessary for the operation of the generator 152 are started, the various components of the HVAC system 100 may be started according to one or more of the methods disclosed herein. In some embodiments, the components of the HVAC system 100 may be started in order of the component comprising the highest startup power requirement to the component comprising the lowest startup power requirement. Accordingly, the compressor 116 may be the first component started in the HVAC system 100. Before starting the compressor 116, however, it may be necessary to unload the compressor 116 by equalizing the pressure across it. In some embodiments, the compressor 116 may comprise a compressor unloading valve 176. In some embodiments, the compressor unloading valve 176 may comprise an actuated valve, a solenoid-controlled valve, and/or a damper which may be configured to control the pressure across the compressor 116. In some embodiments, the compressor unloading valve 176 may be configured in the refrigerant circuit substantially parallel to the compressor 116 such that when the compressor unloading valve 176 is open, refrigerant may travel directly from a compressor discharge side to a compressor intake side thus minimizing the work done by the compressor 116, which may, in some embodiments, reduce the power requirement needed to start the compressor 116. The compressor unloading valve 176 may generally be opened before starting the compressor 116 to equalize the pressure across the compressor 116. The discharge of any pressure within the compressor 116 may generally allow the compressor 116 to start with a decreased startup power requirement as opposed to starting the compressor 116 when it may be pressurized. While the compressor 116 may generally be capable of operating at various speeds, the compressor 116 should be started at its lowest power requirement, which may, in some embodiments, be the lowest operating speed of the compressor 116. Once all of the components of the HVAC system 100 have been started, the speed of the compressor 116 may be adjusted depending on the requirements of the HVAC system 100. In embodiments that may comprise the compressor unloading valve 176, if the compressor unloading valve has been opened, the compressor unloading valve 176 may be closed to enable the compressor 116 to start building a pressure differential. Once the compressor 116 is started, the solenoid-controlled suction valve of the compressor 116 may be closed. The compressor 116 may then continue to operate and build pressure across the compressor 116.

The next component of the HVAC system 100 to be started may be the indoor fan 110. Before the indoor fan 110 is started, it may be necessary to allow the generator 152 to recover from any incurred voltage drop resulting from starting the compressor 116. In some embodiments, the indoor fan 110 may not be started for a predetermined period of time. In other embodiments, the indoor fan 110 may not be started until the power output of the generator 152 reaches a predetermined power output that is commensurate with the generator 152 recovering from the incurred voltage drop. Once the generator 152 is capable of starting the next component, the indoor fan 110 may be started. While the indoor fan 110 may be a variable speed fan that is operational at various speeds, the indoor fan 110 should be started at its lowest power requirement necessary to most efficiently start the indoor fan 110, which may, in some embodiments, be the lowest speed of the indoor fan 110. Once all of the components of the HVAC system 100 have been started, the speed of the indoor fan 110 may be adjusted depending on the requirements of the HVAC system 100.

The next component of the HVAC system 100 to be started may be the outdoor fan 118. Before the outdoor fan 118 is started, it may be necessary to allow the generator 152 to recover from any incurred voltage drop resulting from starting the indoor fan 110. In some embodiments, the outdoor fan 118 may not be started for a predetermined period of time. In other embodiments, the outdoor fan 118 may not be started until the power output of the generator 152 reaches a predetermined power output that is commensurate with the generator 152 recovering from the incurred voltage drop. Once the generator 152 is capable of starting the next component, the outdoor fan 118 may be started. While the outdoor fan 118 may be a variable speed fan that is operational at various speeds, the outdoor fan 118 should be started at its lowest power requirement to most efficiently start the outdoor fan 118, which may, in some embodiments, be the lowest speed of the outdoor fan 118. Once all of the components of the HVAC system 100 have been started, the speed of the outdoor fan 118 may be adjusted depending on the requirements of the HVAC system 100.

In some embodiments, while the components of the HVAC system 100 may comprise variable speed motors, each component may be started at the least power intensive mode, which may generally be the lowest startup power requirement necessary to operate the particular component. In some embodiments, the lowest startup power requirement may place an excessive draw on the auxiliary power source, such as generator 152. In some embodiments, a current limiter, such as a negative temperature coefficient (NTC) thermistor may be connected in series with the power of the component of the HVAC system 100. NTC thermistors may gradually increase the current to the component during startup, so that the generator 152 does not experience a high voltage drop. As such, the generator 152 may be able to control the voltage drop experienced when starting a component that comprises a high momentary power requirement. In some embodiments, NTC thermistors may reduce the amount of time in between starting consecutive components. Accordingly, employing NTC thermistors may provide a more efficient and/or a quicker startup procedure.

Figure 5:
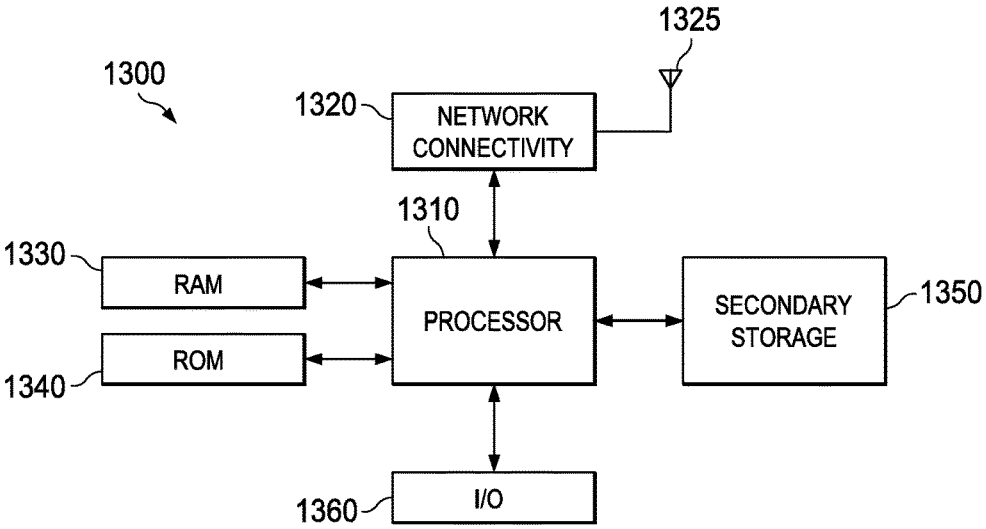
FIG. 5 is a simplified schematic diagram of a general purpose processor or computer that may be used to implement one or more of the embodiments of the disclosure.

FIG. 5 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

a first component comprising a first startup power requirement for operating the first component according to a timing sequence;

a second component comprising a second startup power requirement for operating the second component according to the timing sequence;

an auxiliary power source comprising a generator, wherein the auxiliary power source is configured to selectively provide a first electrical power to the first component at a first time period and the first electrical power to the second component at a second time period, wherein the second time period is later than the first time period;

a controller configured to selectively trigger providing the first electrical power from the auxiliary power source to each of the first component and the second component according to the timing sequence; and an uninterrupted power source comprising a battery, wherein the uninterrupted power source is configured to provide a second electrical power to the controller prior to the auxiliary power source providing the first electrical power to each of the first component and the second component, wherein the first startup power requirement and the second startup power requirement comprise a total startup power requirement that is greater than the power capacity of the auxiliary power source, and wherein the auxiliary power source is configured to wait a predetermined period of time between the first time period and the second time period to stabilize a voltage output at the auxiliary power source prior to providing the first electrical power to each of the first component and the second component.

2. The HVAC system of claim 1, wherein the first startup power requirement is greater than the second startup power requirement.

3. The HVAC system of claim 1, wherein the controller is configured to wait the predetermined period of time between starting the first component and the second component.

4. The HVAC system of claim 1, wherein at least one of the auxiliary power source and the controller is coupled to a sensor that is configured to monitor the voltage output of the auxiliary power source.

5. The HVAC system of claim 1, wherein at least one of the first component and the second component comprise a negative temperature coefficient thermistor configured to control a current supplied by the auxiliary power source to at least one of the first component and the second component.

6. A method of starting a heating, ventilation, and/or air conditioning (HVAC) system, comprising:

providing an auxiliary power source in the HVAC system;

establishing a stable uninterrupted power source to at least one system controller, wherein the stable uninterrupted power source is configured to provide first electrical power independently of a second electrical power from an auxiliary power source;

starting a first component of the HVAC system that comprises a first startup power requirement at a first time period using the second electrical power from the auxiliary power source; and starting a second component of the HVAC system that comprises a second startup power requirement at a second time period using the second electrical power from the auxiliary power source, wherein the second time period is later than the first time period, wherein the sum of the first startup power requirement and the second startup power requirement comprise a total startup power requirement that is greater than the power capacity of the auxiliary power source, wherein the stable uninterrupted power source provides the first electrical power to the at least one system controller prior to the auxiliary power source starting the first component and the second component, and wherein the auxiliary power source is configured to wait a predetermined period of time between the first time period and the second time period to stabilize a voltage output at the auxiliary power source prior to the auxiliary power source starting each of the first component and the second component.

7. The method of starting an HVAC system of claim 6, wherein the first startup power requirement is greater than the second startup power requirement.

8. The method of starting an HVAC system of claim 6, wherein the auxiliary power source comprises a generator.

9. The method of starting an HVAC system of claim 6, wherein the controller is configured to start the first component before the second component.

10. The method of starting an HVAC system of claim 6, wherein the controller is configured to wait the predetermined period of time between starting the first component and the second component.

11. The method of starting an HVAC system of claim 6, wherein at least one of the auxiliary power source and the controller is coupled to a sensor that is configured to monitor the voltage output of the auxiliary power source.

12. The method of starting an HVAC system of claim 6, further comprising:

measuring a heat transfer fluid temperature of a heat transfer fluid of the auxiliary power source; and starting a coolant pump of the auxiliary heat source if the heat transfer fluid temperature exceeds a predetermined heat transfer fluid temperature threshold.

13. The method of starting an HVAC system of claim 6, wherein the starting a first component of the HVAC system comprises starting the first component of the HVAC system at a first component operating speed that is less than a maximum first component operating speed.

14. The method of starting an HVAC system of claim 6, wherein the starting a second component of the HVAC system comprises starting the second component of the HVAC system at a second component operating speed that is less than a maximum second component operating speed.

* * * * *